US010286429B2

(12) United States Patent
Roberts

(10) Patent No.: US 10,286,429 B2
(45) Date of Patent: May 14, 2019

(54) METHOD OF USE FOR CLEANING VERTICAL STACK PLUMBING SYSTEMS

(71) Applicant: Total Pipeline Cleaning Service, Inc., Sarasota, FL (US)

(72) Inventor: Terry Lee Roberts, Sarasota, FL (US)

(73) Assignee: Total Pipeline Cleaning Service, Inc., Sarasota, FL (US)

( * ) Notice: Subject to any disclaimer, the term of this patent is extended or adjusted under 35 U.S.C. 154(b) by 0 days.

(21) Appl. No.: 15/950,523

(22) Filed: Apr. 11, 2018

(65) Prior Publication Data

US 2018/0290186 A1 Oct. 11, 2018

Related U.S. Application Data

(60) Provisional application No. 62/484,186, filed on Apr. 11, 2017.

(51) Int. Cl.

| | |
|---|---|
| ***B08B 9/02*** | (2006.01) |
| ***B08B 9/027*** | (2006.01) |
| ***B24C 1/00*** | (2006.01) |
| ***B08B 9/057*** | (2006.01) |
| ***B08B 9/032*** | (2006.01) |
| ***B24C 3/32*** | (2006.01) |

(52) U.S. Cl.

CPC ..... *B08B 9/057* (2013.01); *B08B 9/027* (2013.01); *B08B 9/032* (2013.01); *B24C 3/327* (2013.01)

(58) Field of Classification Search

None

See application file for complete search history.

(56) References Cited

U.S. PATENT DOCUMENTS

| | | | | |
|---|---|---|---|---|
| 2,034,195 A * | 3/1936 | Marker | B08B 9/057 15/3.51 |
| 3,805,826 A | 4/1974 | Westerhoff | |
| 5,004,025 A | 4/1991 | Robbins | |
| 6,199,576 B1 * | 3/2001 | Young | E03F 7/04 137/242 |

(Continued)

OTHER PUBLICATIONS

International Search Report and Written Opinion for PCT/US2018/27082 dated Jul. 6, 2018 (11 pages).

*Primary Examiner* — Katelyn B Whatley

(74) *Attorney, Agent, or Firm* — Shumaker, Loop & Kendrick, LLP

(57) ABSTRACT

Disclosed are cleaning devices and methods of use thereof for cleaning a vertical stack plumbing system. The cleaning device includes a first cylindrical body defining a first opening for selectively introducing a predetermined amount of cleaning medium into the cleaning device; a second cylindrical body defining a second opening configured to maintain airflow and venting of the vertical stack plumbing system when the cleaning device is in use, the first and second cylindrical bodies being directly connected to a main body of the cleaning device and in fluid communication with one another through the main body; and an attachment member defining a third opening that is directly connected to the main body of the cleaning device, the attachment member configured for direct removable attachment to a plumbing waste pipe in the vertical stack plumbing system and for receiving the cleaning medium therethrough to introduce the cleaning medium into the vertical stack plumbing system.

8 Claims, 8 Drawing Sheets

(56) References Cited

U.S. PATENT DOCUMENTS

| | | | | |
|---|---|---|---|---|
| 2004/0226580 | A1* | 11/2004 | Shiraishi | B08B 9/057 134/22.1 |
| 2009/0173396 | A1 | 7/2009 | Spadavecchia | |
| 2015/0013724 | A1* | 1/2015 | Grenier | B08B 9/035 134/18 |
| 2016/0108608 | A1 | 4/2016 | Williams | |
| 2017/0096806 | A1* | 4/2017 | Salzer | E03C 1/304 |

* cited by examiner

METHOD OF USE FOR CLEANING VERTICAL STACK PLUMBING SYSTEMS

TECHNICAL FIELD

The present invention generally relates to the field of plumbing, and more particularly, to devices and methods for cleaning vertical stack plumbing systems in mid-rise and high-rise buildings.

BACKGROUND

Vertical stack plumbing systems 10 such as the one shown in FIG. 1 are frequently used in mid-rise and high-rise buildings. These systems allow for efficient plumbing of mid-rise and high-rise buildings 1. However, as further evidenced by FIG. 1, these vertical stack plumbing systems are often a complex, labyrinth of interconnected toilet waste pipes 11, sink waste pipes 12, shower waste pipes 13, various venting and other miscellaneous pipes 14 extending throughout mid-rise and high-rise buildings.

While these vertical stack plumbing systems allow for efficient plumbing especially during construction and for the first few years post-construction of these mid-rise and high-rise buildings, cleaning and maintaining these systems is quite problematic. For example, as mid-rise and high-rise buildings age, routine maintenance and cleaning is necessary to maintain operability of these systems otherwise frequent drain blockage and leaks occur. Conventional plumbing snakes and augers are currently used in an attempt to clean and maintain operability of these vertical stack systems. However, due to the labyrinth-like construction of these vertical stack systems, using plumbing snakes and augers is often less than ideal because little control may be maintained over the plumbing snakes/augers while attempting to clean these systems—often resulting in snake/auger movement being hindered within the vertical stack system consequently resulting in sub-optimal cleaning of the vertical stack plumbing system.

BRIEF SUMMARY OF THE INVENTION

Therefore, a need exists to provide devices and methods to more efficiently clean vertical stack systems that overcome the above-mentioned problems. Thus, disclosed are removable cleaning devices and methods of using these devices to clean vertical stack plumbing systems.

Specifically disclosed are cleaning devices adapted to clean a vertical stack plumbing system, the cleaning device including (a) a first cylindrical body defining a first opening for selectively introducing a predetermined amount of cleaning medium into the cleaning device; (b) a second cylindrical body defining a second opening configured to maintain airflow and venting of the vertical stack plumbing system when the cleaning device is in use, the first and second cylindrical bodies being directly connected to a main body of the cleaning device and in fluid communication with one another through the main body; and (c) an attachment member defining a third opening that is directly connected to the main body of the cleaning device, the attachment member configured for direct removable attachment to a plumbing waste pipe in the vertical stack plumbing system and to receive the cleaning medium therethrough to introduce the cleaning medium into the vertical stack plumbing system.

Also disclosed is a method of using the cleaning device(s) to clean a vertical stack plumbing system. The method includes (a) maintaining one plumbing waste pipe open in the vertical stack plumbing system while blocking off all other plumbing waste pipes and venting structures in the vertical stack plumbing system; (b) securely attaching the attachment member of the cleaning device to the one open plumbing waste pipe; (c) securely attaching a vacuum source (preferably a vacuum from an industrial strength hydrovac truck) to a base of the vertical stack plumbing system; (d) providing a cleaning medium into the first cylindrical body of the device; (e) applying a vacuum from the vacuum source to the vertical stack plumbing system to facilitate passing of the cleaning medium through the vertical stack towards the vacuum; (f) selectively introducing the cleaning medium into the vertical stack plumbing by opening a partition positioned in the first cylindrical body such that a predetermined amount of cleaning medium flows through the first cylindrical body into the main body of the device and from the main body into the attachment member of the device while the second cylindrical body of the device concurrently maintains airflow and vents of the vertical stack plumbing system; and (g) following step (f), passing the medium from the attachment member into the vertical stack plumbing system towards the vacuum thereby cleaning and/or abrading inner surfaces of the vertical stack plumbing system while moving towards the vacuum. In certain aspects, different medium is selectively introduced into the device and passed through the vertical stack to ensure optimal cleaning of the stack. For example, in certain aspects and for portions of the stack having grease build-up, ice may be a first medium introduced provided into the device and subsequently passed through the vertical stack. After passing the ice through the device and stack, a second medium (e.g., spherical shaped pea gravel or glass) may be provided to the device and passed through the vertical stack. By introducing different mediums (e.g., ice initially in a portions having grease build-up and then pea gravel or glass) sequentially into the device and through the vertical stack, cleaning of the vertical stack may be optimized.

In certain aspects, the cleaning medium is a solid medium including, but not limited to, spherical shaped pea gravel, ice, or glass having a diameter of ½ inch or less.

Embodiments of the invention can include one or more or any combination of the above features and configurations.

Additional features, aspects and advantages of the invention will be set forth in the detailed description, which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
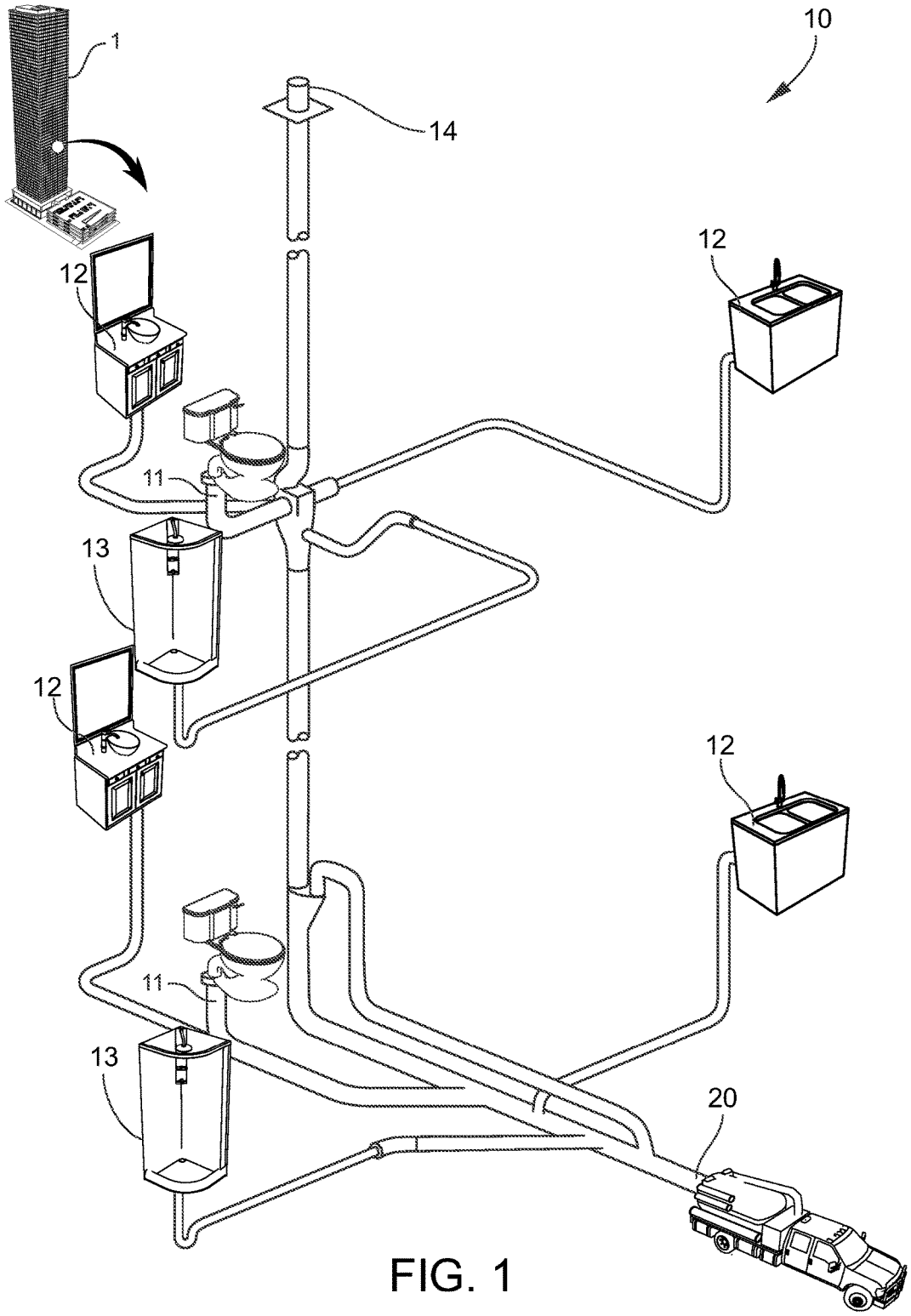
FIG. 1 depicts an exemplary mid-rise or high-rise building with a magnified view of an exemplary vertical stack plumbing system utilized therein.
Figure 2B:
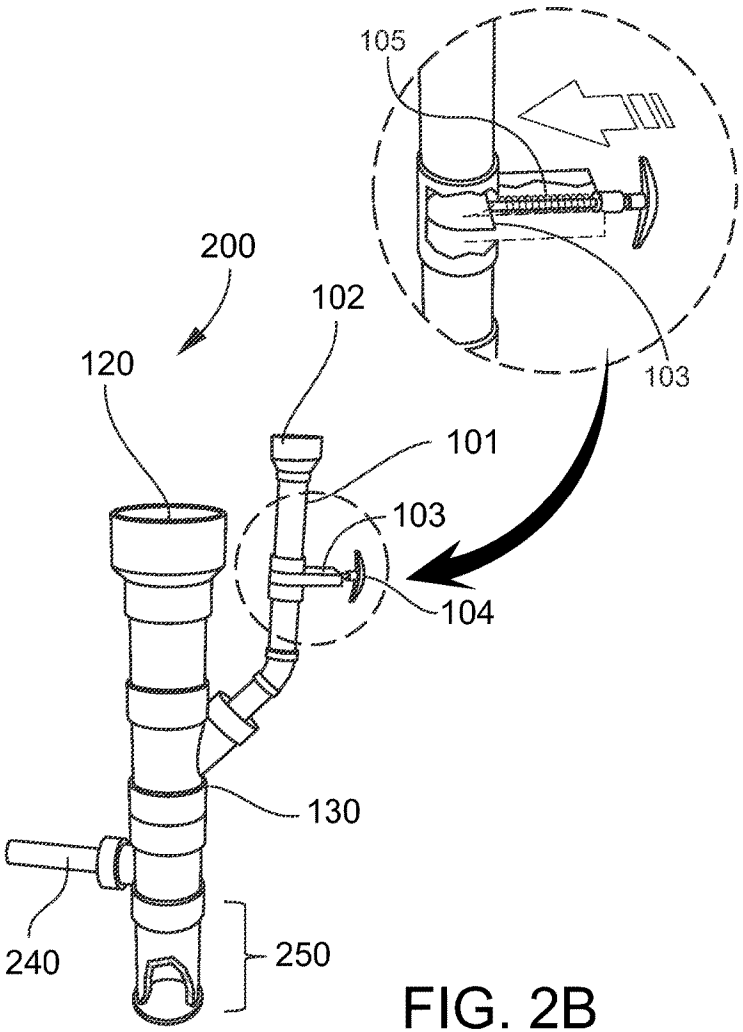
FIGS. 2A and 2B each depict exemplary embodiments of the cleaning devices used for cleaning vertical stack plumbing systems, with each further including magnified views of the partition included therein that is configured to selectively introduce cleaning medium into the device and the vertical stack plumbing system.
Figure 2A:
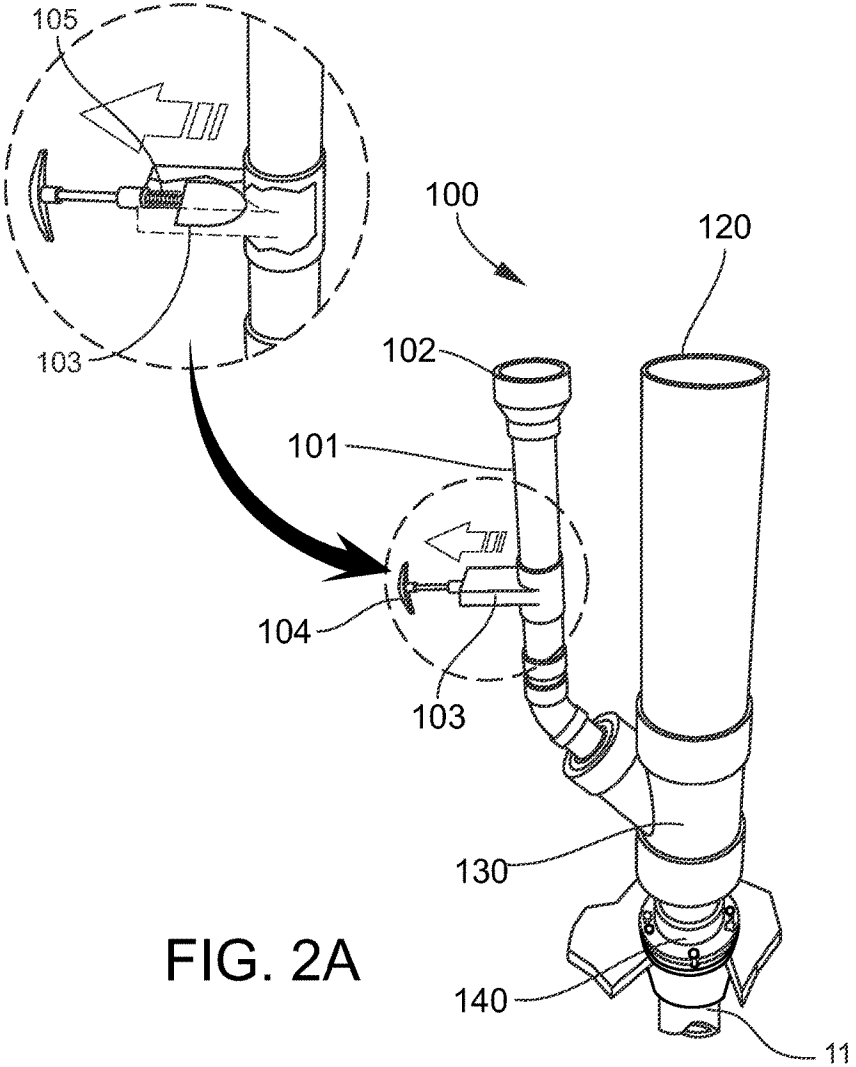

As shown in FIGS. 2A and 2B, at least two embodiments of the cleaning devices 100, 200 for cleaning a vertical stack plumbing system are envisioned. In view of FIGS. 1-8B, specifically disclosed herein are cleaning devices 100, 200 adapted to clean a vertical stack plumbing system 10. The cleaning devices 100, 200 each include (a) a first cylindrical body 101 defining a first opening for selectively introducing a predetermined amount of cleaning medium 400 into the cleaning device; (b) a second cylindrical body 120 defining a second opening configured to maintain airflow and venting of the vertical stack plumbing system when the cleaning device 100, 200 is in use, the first and second cylindrical bodies 101, 120 being directly connected to a main body 130 of the cleaning device and in fluid communication with one another through the main body 130; and (c) an attachment member 140, 240 defining a third opening that is directly connected to and in fluid communication with the main body 130 of the cleaning device. The attachment member 140, 240 configured for direct removable attachment to a plumbing waste pipe (e.g., 11 and/or 12 as shown in FIG. 1) in the vertical stack plumbing system 10. The attachment member 140, 240 is configured for receiving the cleaning medium 400 therethrough to introduce the cleaning medium into the vertical stack plumbing system 10 via the desired waste pipe (e.g., 11 and/or 12 as shown in FIG. 1) to which the device 100, 200 is attached.

As shown in FIGS. 2A and 2B, the first and second cylindrical bodies 101, 120 differ in outer and inner diameter. For example, the second cylindrical body 120 has a greater outer and inner diameter than the first cylindrical body to maintain adequate airflow and venting (e.g., cyclonic type airflow) in the system when using the devices 100, 200 and methods as described further below (when concurrently used with a vacuum source attached to the system's based 20).

As further shown in FIGS. 2A and 2B, the first and second cylindrical bodies 101, 120 are substantially parallel to one another, which aids the user by making the devices 101, 120 easier to use. A funnel 102 is preferably attached to one end of the first cylindrical body 101 that aids in receiving and feeding the medium into the first cylindrical body. As further shown in FIGS. 2A-8B, each device 100, 200 includes a partition 103 positioned within the first cylindrical body 101 that is configured to selectively open and close the first cylindrical body such that the cleaning medium is selectively introduced into the main body 130 and subsequently to the attachment member 140, 240 by selectively opening and closing the partition 103 in the first cylindrical body 101. The partition 103 is preferably substantially planar and is positioned perpendicular to the longitudinal axis (flow path) of the first cylindrical body 101, thus moving the partition in a direction away from the devices 100, 200 opens the flow path and introduces the medium.

Partition 103 is operatively connected to a biasing member 105 (e.g., a spring) and handle 104. The biasing member 105 biases the partition 103 in a direction towards the device, thus maintaining the partition in a closed position and blocking the flow path of the first cylindrical body 101 when the handle is not actuated in a direction away from the devices 100, 200. To move the partition and open the flow path of the first cylindrical body 101, the user actuates/moves the handle in a direction away from the devices 100, 200 and opposite the biasing member thereby opening the flow path of the first cylindrical body 101.

In certain aspects, the first cylindrical body 101 is attached to the main body 130 via an elbow that is angled and extends away from the main body. As shown in FIGS. 2A-8B, the first and second cylindrical bodies 101, 120 are directly connected to the main body 130 of the cleaning devices 100, 200 and are in fluid communication with one another through the main body 130.

Figure 3:
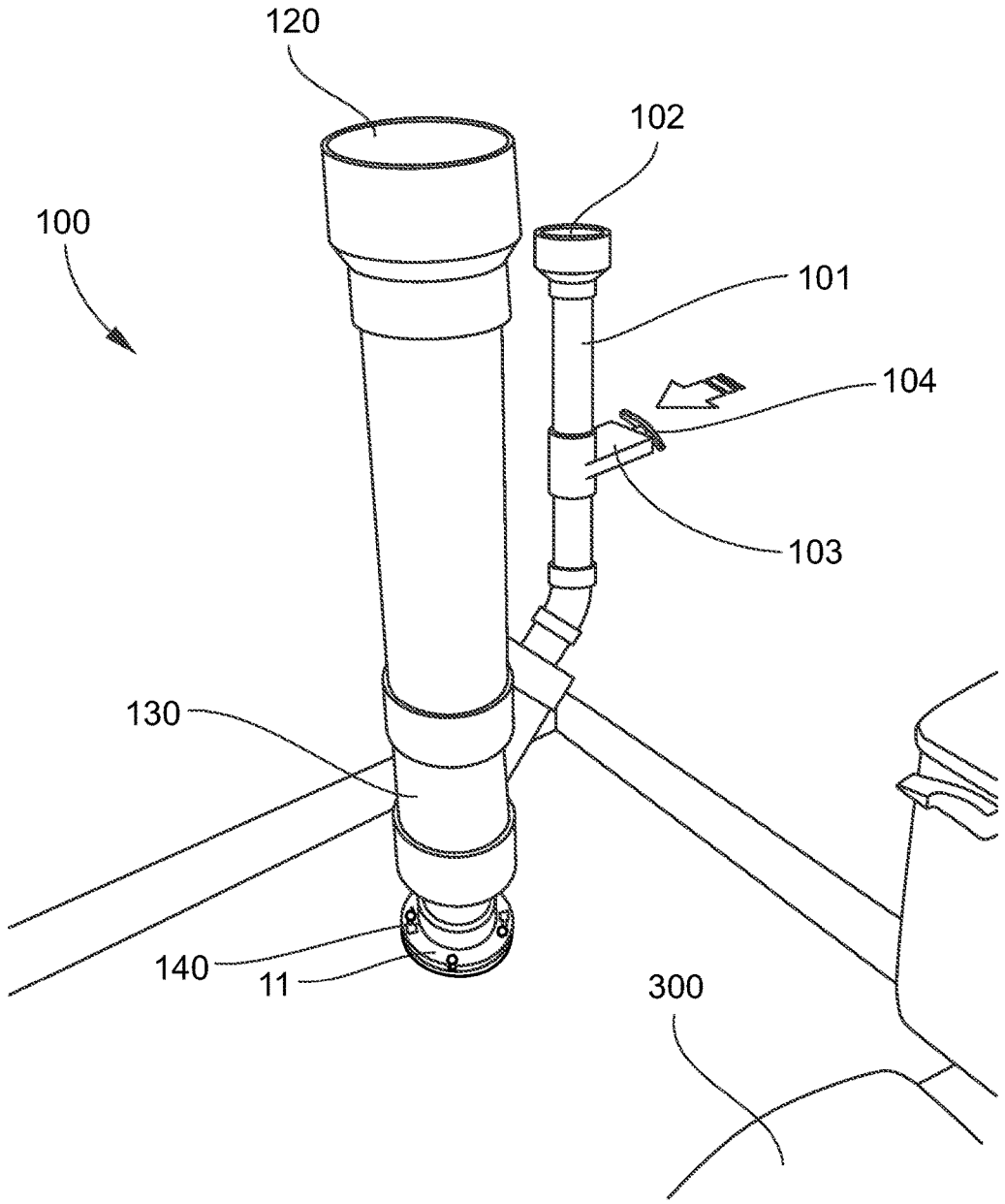
FIG. 3 depicts an exemplary cleaning device attached to a toilet seal annular flange.
Figure 4:
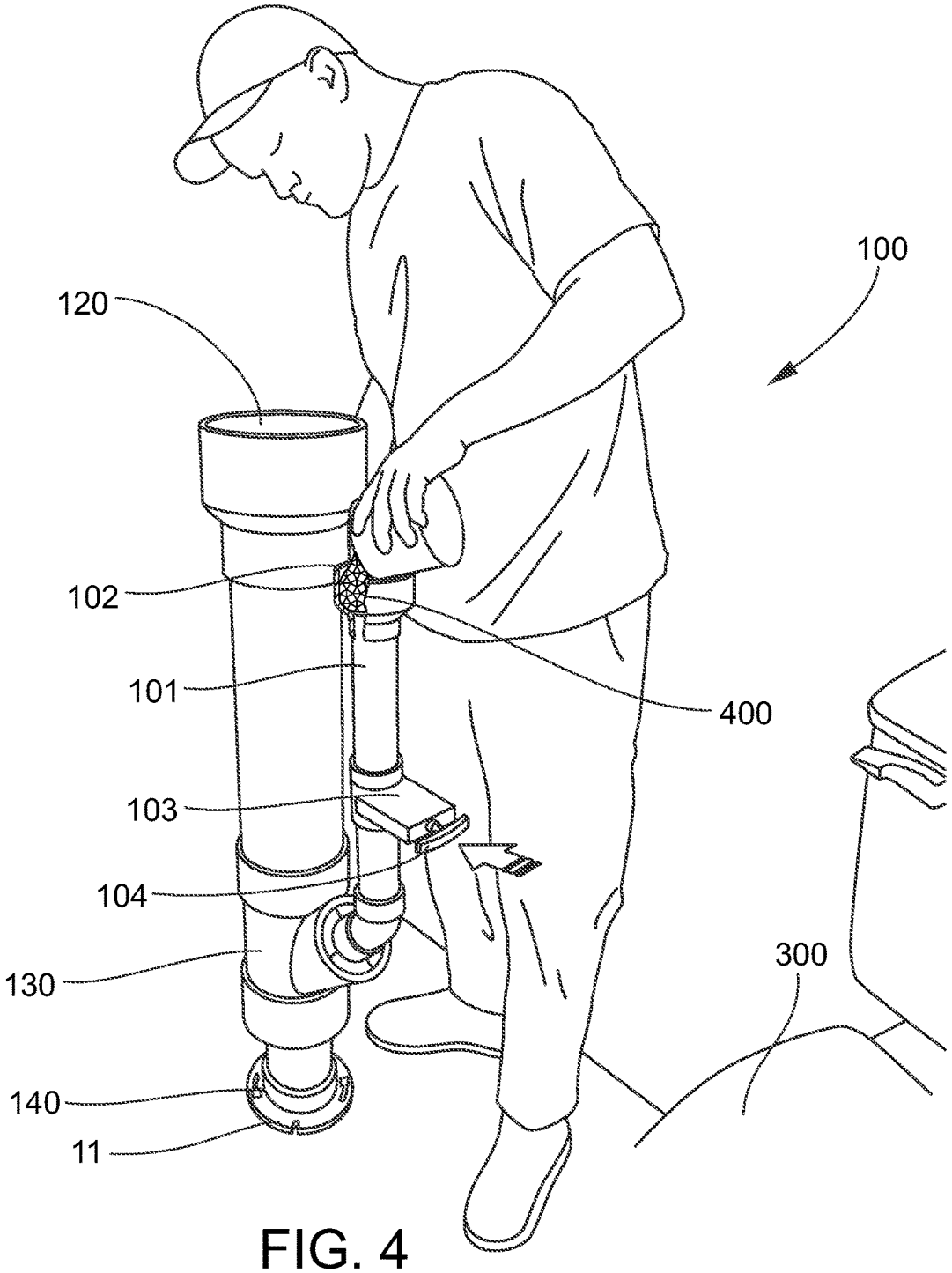
FIG. 4 depicts pouring cleaning medium into the exemplary device of FIG. 3.
Figure 5:
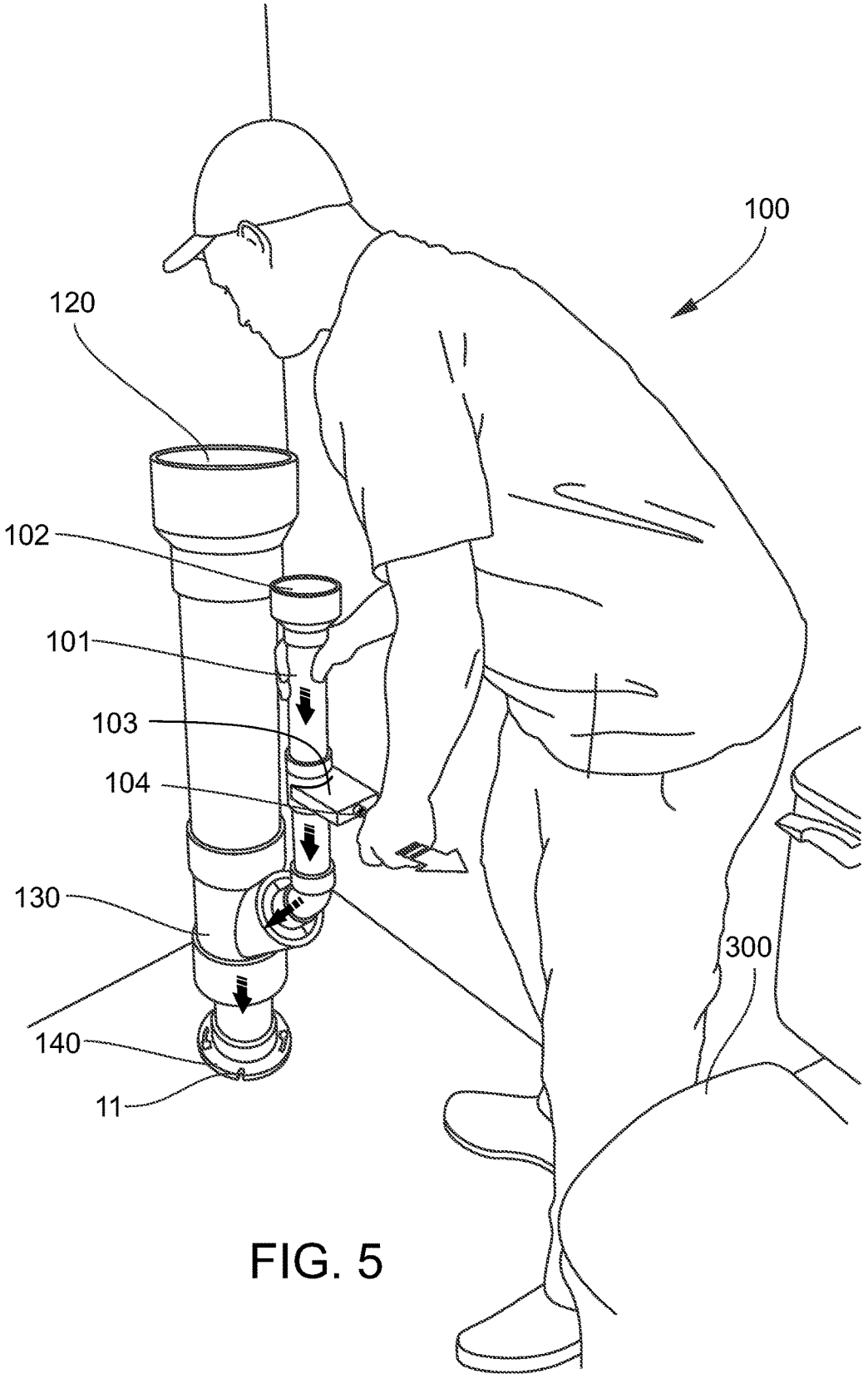
FIG. 5 depicts selectively introducing the medium in the exemplary device of FIG. 4 into the toilet waste drain of the vertical stack plumbing system by actuating the partition into an open position.

As alluded to above, the devices 100, 200 disclosed herein can be attached to a desired waste pipe 11, 12 in a vertical stack plumbing system. The desired waste pipes disclosed herein include, but are not limited to, a toilet waste pipe 11 and/or a sink waste pipe 12 (sink waste arm) as shown in FIG. 1. In certain aspects, the cleaning device 100 of FIG. 2A, and as further shown in FIGS. 3-5, is adapted for direct attachment via attachment member 140 to a toilet waste pipe. The toilet waste pipe includes, for example, an annular flange with a toilet seal seated therein, and in certain aspects, the attachment member 140 is an annular flange of the cleaning device configured for removable attachment thereto. As described further below, the cleaning device 100 of FIG. 2A cleans the vertical stack by selectively introducing medium into the plumbing system as desired by the device user.

In certain aspects, the cleaning device 200 of FIG. 2B slightly varies from the cleaning device 100. Specifically, device 200 includes solid base 250 positioned directly below the main body 130 and attachment member 240. As further shown in FIG. 2B, attachment member 240 extends perpendicular relative to the longitudinal axis of the device (second cylindrical body 120) and is adapted to securely attach to a sink waste pipe 12 (sink waste arm). Because most sink waste arms are elevated between 12 to 18 inches above the floor, base 250 provides device 200, and more particularly attachment member 240, with adequate height to be securely attached to the sink waste pipe 12.

FIGS. 3-5 depict sequential views of the device 100 attached to toilet waste pipe 11, with the toilet 300 being removed and offset from waste pipe 11, via attachment member 140 and in use to clean the system 10. Specifically, FIG. 3 depicts device 100 attached to a toilet seal annular flange 11 before the introduction of cleaning medium 400. FIG. 4 depicts pouring cleaning medium 400 into the exemplary device of FIG. 3 and further depicts partition 103 biased towards the device and being in a closed position (as indicated by the arrow). FIG. 5 depicts the device user actuating handle 104 away (as indicated by arrow) from the device 100 thereby moving partition 103 into an open position and subsequently selectively introducing the cleaning medium 400 into the main body 130 and attachment member 140 as shown by the flow path (indicated with black arrows in FIG. 5).

Figure 6:
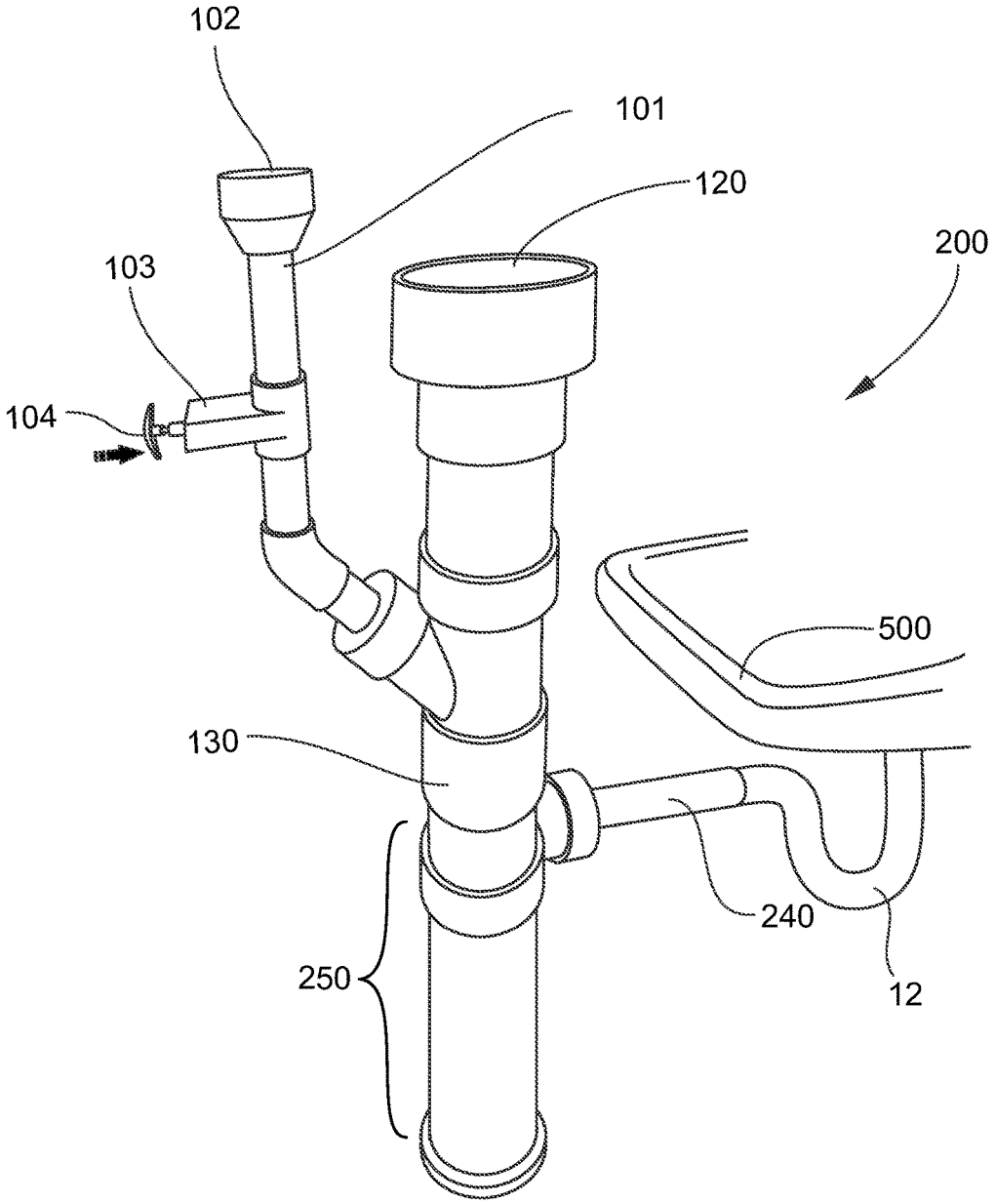
FIG. 6 depicts an exemplary device attached to a sink waste arm beneath the sink.
Figure 7:
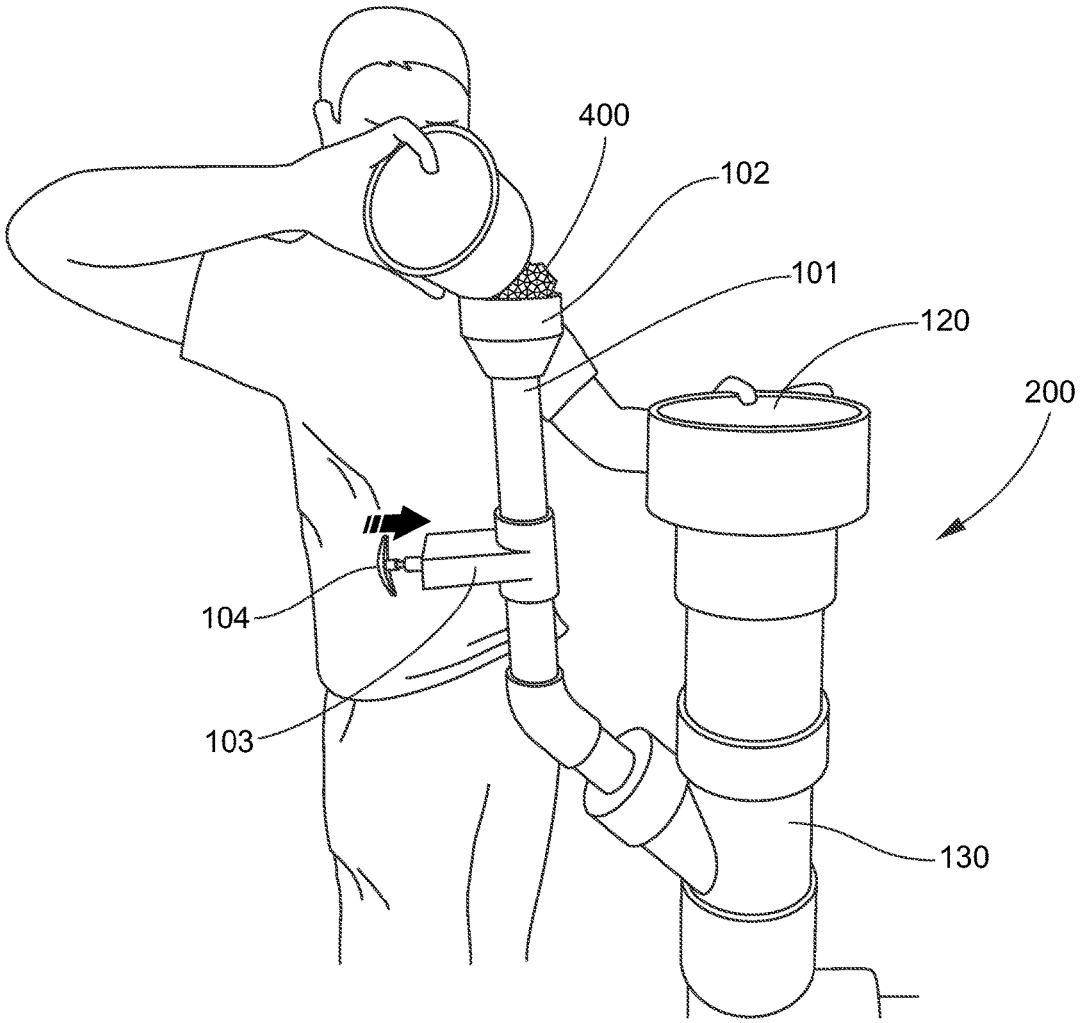
FIG. 7 depicts pouring cleaning medium into the exemplary device of FIG. 6.
Figure 8B:
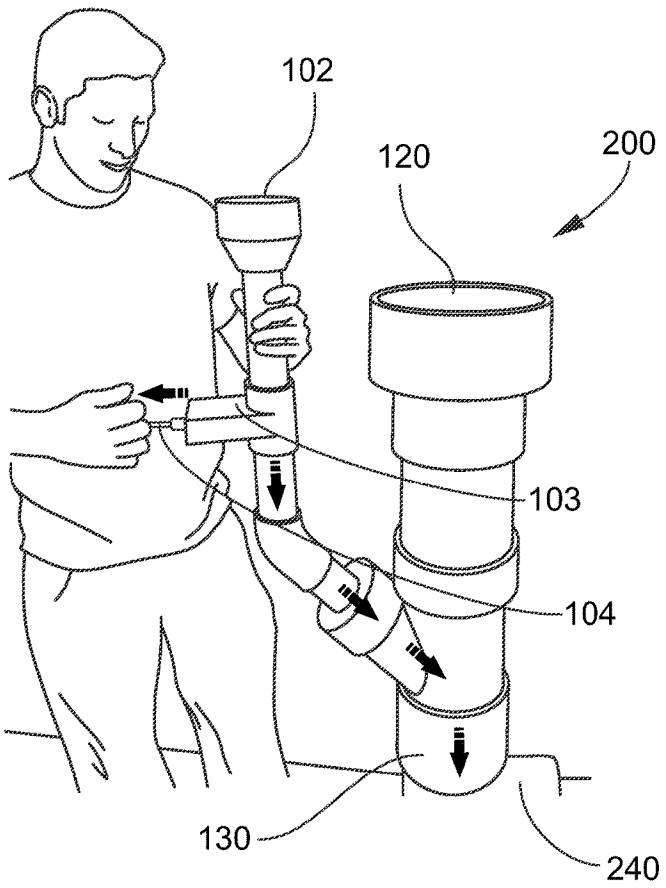
FIGS. 8A and 8B sequentially depict selectively introducing the medium in the exemplary device of FIG. 7 into the sink waste arm of the vertical stack plumbing system by actuating a partition into an open position.
Figure 8A:
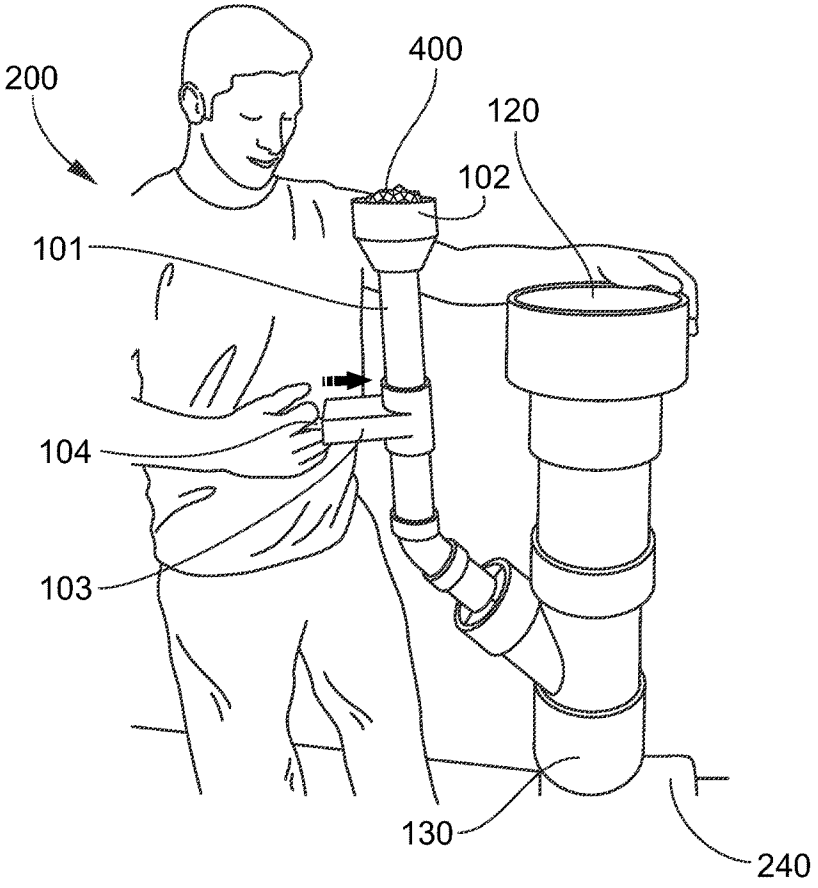

Similarly, FIGS. 6-8A depict sequential views of the device 200 attached to sink waste pipe 12 of sink 500 via attachment member 240 and in use to clean the system 10. Specifically, FIG. 6 depicts device 200 attached to a sink waste arm beneath the sink 500 via attachment member 240 before the introduction of cleaning medium 400. FIG. 7 depicts pouring cleaning medium 400 into device 200 of FIG. 6 and further depicts partition 103 biased towards the device 200 and being in a closed position (as indicated by the arrow). FIG. 8A depicts the device user gripping the handle 104 and preparing to actuate the handle 104 away from the device in order to selectively introduce the cleaning medium 400. FIG. 8B depicts the device user actuating handle 104 away from the device 100 thereby moving partition 103 into an open position and subsequently selectively introducing the cleaning medium 400 into the main body 130 and attachment member 240 as shown by the flow path (indicated with black arrows in FIG. 8B).

In certain aspects, the cleaning medium is a solid medium including, but not limited to, spherical shaped pea gravel, ice, or glass having a diameter of ½ inch or less.

In view of the above disclosures and FIGS. 1-8B, the devices 100, 200 are used in conjunction with a vacuum source (preferably an industrial strength hydrovac truck) as further disclosed below to clean vertical stack plumbing systems 10. Specifically disclosed are methods of using the above disclosed cleaning devices 100, 200 to clean a vertical stack plumbing system, by (a) maintaining one plumbing waste pipe open (e.g. 11 or 12) in the vertical stack plumbing system 10 while blocking off all other plumbing waste pipes and venting structures in the vertical stack plumbing system 10; (b) securely attaching the attachment member 140, 240 of the cleaning device 100, 200 to the one open plumbing waste pipe; (c) securely attaching a vacuum source (not shown) to a base 20 of the vertical stack plumbing system 10; (d) providing a cleaning medium 400 into the first cylindrical body 101 of the device 100, 200; (e) applying a vacuum from the vacuum source to the vertical stack plumbing system 10 to facilitate passing of the cleaning medium 400 through the vertical stack towards the vacuum; (f) (as shown in FIGS. 5 and 8A) selectively introducing the cleaning medium 400 into the vertical stack plumbing system 10 by opening a partition 103 positioned in the first cylindrical body 101 such that a predetermined amount of cleaning medium 400 flows through the first cylindrical body 101 into the main body 130 of the device and from the main body 130 into the attachment member 140, 240 of the device 100, 200 while the second cylindrical body 120 of the device concurrently maintains airflow and vents of the vertical stack plumbing system; and (g) following step (f), passing the medium 400 from the attachment member 140, 240 into the vertical stack plumbing system 10 towards the vacuum (attached to base 20 of system 10) thereby cleaning and/or abrading inner surfaces of the vertical stack plumbing system 10 while moving towards the vacuum. To further clean the entire vertical stack plumbing system, this method is preferably repeated at each of the waste pipes 11, 12, 13 of the system 10 to ensure that the vertical stack plumbing system 10 is thoroughly cleaned. In certain aspects, different medium is selectively introduced into the device and passed through the vertical stack to ensure optimal cleaning of the stack. For example, in certain aspects and for portions of the stack having grease build-up, ice may be a first medium introduced provided into the device and subsequently passed through the vertical stack. After passing the ice through the device and stack, a second medium (e.g., spherical shaped pea gravel or glass) may be provided to the device and passed through the vertical stack. By introducing different mediums (e.g., ice initially in a portions having grease build-up and then pea gravel or glass) sequentially into the device and through the vertical stack, cleaning of the vertical stack may be optimized. For example and upon completing step (f) or step (g), the method can further comprise the following: (h) introducing a second cleaning medium that is pea gravel and/or glass into the first cylindrical body of the device; (i) applying a vacuum from the vacuum source to the vertical stack plumbing system to facilitate passing of the second cleaning medium through the vertical stack towards the vacuum; (j) selectively introducing the second cleaning medium into the vertical stack plumbing by opening a partition positioned in the first cylindrical body such that a predetermined amount of cleaning medium flows through the first cylindrical body into the main body of the device and from the main body into the attachment member of the device while the second cylindrical body of the device concurrently maintains airflow and vents of the vertical stack plumbing system; and (k) following step (j), passing the second cleaning medium from the attachment member into the vertical stack plumbing system towards the vacuum thereby cleaning and/or abrading inner surfaces of the vertical stack plumbing system while moving towards the vacuum.

In certain aspects, the cleaning devices disclosed herein can also be used in conventional plumbing systems (e.g., horizontal and/or residential plumbing systems), and in certain further aspects, the vertical stack plumbing system may specifically include a so-vent vertical stack plumbing system.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A method of using a cleaning device adapted to clean a vertical stack plumbing system, the method comprising:

(a) maintaining one plumbing waste pipe open in the vertical stack plumbing system while blocking off all other plumbing waste pipes and venting structures in the vertical stack plumbing system;

(b) securely attaching an attachment member of the cleaning device to the one open plumbing waste pipe;

(c) securely attaching a vacuum source to a base of the vertical stack plumbing system, wherein the base of the vertical stack plumbing system is at a different end of the vertical stack plumbing system relative to the plumbing waste pipe to which the cleaning device is securely attached;

(d) providing a cleaning medium into a first cylindrical body of the device, wherein the cleaning medium comprises a solid medium;

(e) applying a vacuum from the vacuum source to the vertical stack plumbing system to facilitate passing of the cleaning medium through the vertical stack towards the vacuum;

(f) selectively introducing the cleaning medium into the vertical stack plumbing by opening a partition positioned in the first cylindrical body such that a predetermined amount of cleaning medium flows through the first cylindrical body into the main body of the device and from the main body into the attachment member of the device while the second cylindrical body of the device concurrently maintains airflow and vents of the vertical stack plumbing system; and (g) following step (f), passing the medium from the attachment member into the vertical stack plumbing system towards the vacuum thereby cleaning and/or abrading inner surfaces of the vertical stack plumbing system while moving towards the vacuum, wherein:

the cleaning device adapted to clean a vertical stack plumbing system comprises:

(i) the first cylindrical body defining a first opening for selectively introducing a predetermined amount of cleaning medium into the cleaning device;

(ii) a second cylindrical body defining a second opening configured to maintain airflow and venting of the vertical stack plumbing system when the cleaning device is in use, the first and second cylindrical bodies being directly connected to a main body of the cleaning device and in fluid communication with one another through the main body; and (iii) the attachment member defining a third opening that is directly connected to the main body of the cleaning device, the attachment member configured for direct removable attachment to the one plumbing waste pipe open in the vertical stack plumbing system and to receive the cleaning medium therethrough to introduce the cleaning medium into the vertical stack plumbing system.

2. The method of claim 1, wherein the cleaning medium comprises spherical shaped pea gravel, ice, or glass having a diameter of ½ inch or less.

3. The method of claim 1, wherein the medium is ice.

4. The method of claim 3, further comprising upon completing step (f) or step (g) the following:

(h) introducing a second cleaning medium that is pea gravel and/or glass into the first cylindrical body of the device;

(i) applying a vacuum from the vacuum source to the vertical stack plumbing system to facilitate passing of the second cleaning medium through the vertical stack towards the vacuum;

(j) selectively introducing the second cleaning medium into the vertical stack plumbing by opening a partition positioned in the first cylindrical body such that a predetermined amount of cleaning medium flows through the first cylindrical body into the main body of the device and from the main body into the attachment member of the device while the second cylindrical body of the device concurrently maintains airflow and vents of the vertical stack plumbing system; and (k) following step (j), passing the second cleaning medium from the attachment member into the vertical stack plumbing system towards the vacuum thereby cleaning and/or abrading inner surfaces of the vertical stack plumbing system while moving towards the vacuum.

5. The method of claim 2, wherein the cleaning medium is either spherical shaped pea gravel or glass.

6. The method of claim 4, wherein the second cleaning medium is spherical shaped pea gravel or glass.

7. The method of claim 1, wherein the cleaning medium consists of the solid medium.

8. The method of claim 4, wherein the second cleaning medium consists of a solid medium.

* * * * *